United States Patent [19]

Klasing

[11] 4,291,793

[45] Sep. 29, 1981

[54] HAND BRAKE MECHANISM ADAPTED FOR USE ON A RAILWAY CAR

[75] Inventor: Wayne G. Klasing, New Lenox, Ill.

[73] Assignee: Klasing Industries, Inc., Joliet, Ill.

[21] Appl. No.: 84,914

[22] Filed: Oct. 15, 1979

[51] Int. Cl.[3] ..... F16D 13/60; G05G 1/08

[52] U.S. Cl. ..... 192/95; 192/114 R; 74/505; 192/89 A; 192/101

[58] Field of Search ..... 192/89 A, 101, 114 R, 192/67 R, 95; 74/505, 506, 504

[56] References Cited

U.S. PATENT DOCUMENTS

| | | | |
|---|---|---|---|
| 3,040,597 | 6/1962 | Bretz | 74/505 |
| 3,425,294 | 2/1969 | Klasing | 74/505 |
| 3,988,944 | 11/1976 | Klasing | 74/505 |
| 4,043,226 | 8/1977 | Buuck | 192/89 A X |

*Primary Examiner*—George H. Krizmanich
*Attorney, Agent, or Firm*—Gerlach, O'Brien & Kleinke

[57] ABSTRACT

A hand brake mechanism of the quick-release type having locking structure preventing accidental brake release includes a clutch collar interconnecting a drive member mounted on a shaft for rotation therewith and a pinion mounted on the shaft for rotation relative thereto and for being operatively connected in a power train to the car brakes. The collar is shiftable on the shaft between a drive position making the aforesaid interconnection, and a brake-release position wherein the connection is broken and the pinion is freely rotatable on the shaft. A pivotally mounted shift lever has collar-engaging members for shifting the collar between such positions. A cam shaft is provided with a cam which, when the cam shaft is rotated in one direction, engages the shift lever to shift the collar into the brake-release position. The cam shaft also is provided with a reaction member having a cam surface which, when the cam shaft is rotated in the opposite direction, engages the shift lever to shift the collar into the drive position, and having a stop surface which engages the shift lever when the collar is in the drive position, to positively and mechanically lock the collar in the drive position. A second reaction member is provided on the cam shaft, in a preferred structure, such member engaging the collar when it is in the drive position, also to positively and mechanically lock the collar in its drive position. Any forces which may be experienced, tending to shift the collar out of its drive position when locked therein by the reaction members, act on the reaction members in opposite directions, so that the forces are assimilated by the cam shaft.

8 Claims, 10 Drawing Figures

HAND BRAKE MECHANISM ADAPTED FOR USE ON A RAILWAY CAR

BACKGROUND OF THE INVENTION

This invention relates to hand brake mechanisms adapted for use on railway cars. More particularly, the invention relates to mechanisms of the quick-release type having locking structures preventing accidental brake release.

My U.S. Pat. Nos. 3,425,294 and 3,988,944 disclose hand brake mechanisms of the quick-release type, which are adapted for use on railway cars. The disclosed mechanisms also incorporate structure providing for gradual release of the car brakes. Both gradual and quick release are effected without spinning of the handwheel which is manually rotated for application and for gradual release of the brakes. More particularly, two clutches are arranged in series relationship in a power train from the handwheel to the car brakes. A self-energizing friction clutch associated with coaxial separate shafts in the power train provides for gradual release of the brakes. A manually-operated clutch of the jaw type provides for quick release of the brakes. The mechanism of the patents includes a pivoted yoke assembly having shift lever or fork components, and a cam shaft having a handle or lever connected thereto for manual operation. The cam shaft is provided with a cam operating in one direction of rotation of the shaft to pivotally move the yoke assembly so as to separate components of the quick-release clutch for releasing the brakes. A second cam on the cam shaft functions upon rotation of the cam shaft in the opposite direction to cam the yoke assembly in a direction to drivingly engage the clutch components, and to assist a biasing spring in maintaining the engagement of the components.

U.S. Pat. No. 3,040,597 discloses a non-spin hand brake mechanism having gradual-release and quick-release clutch structures arranged in series in a power train from a handwheel to the car brakes. The mechanism includes a trip bar means or yoke assembly for operation of the quick-release clutch, and a trip cam means engaging and pivotally moving the trip bar means. The trip cam means includes a cam arm on a cam shaft, and the cam arm engages the trip bar means for disengaging components of the quick-release clutch. A safety arm also is provided on the cam shaft, and it overlies one component of the quick-release clutch when its components are in driving engagement, to prevent the one component from moving out of such engagement.

SUMMARY OF THE INVENTION

The structure of the present invention provides improved protection against accidental separation of the components of a quick-release clutch or the like in a hand brake mechanism, with resulting unwanted brake release. Such separation might be caused, for example, by malfunctioning of the mechanism, by wear of parts resulting in slippage under load, or by interference with proper operation of parts.

Improved protection in accordance with the invention is provided by a relatively simple modification of the structure disclosed in my above-identified patents, which modification serves to positively and mechanically lock a collar component of the quick-release clutch in its drive position, whereby the clutch components are secured in driving engagement.

In a preferred embodiment of the invention, the cam shaft of my above-identified patents, provided with the foregoing modification, is provided with additional structure which also acts to positively and mechanically lock the collar in its drive position, and any forces which may be experienced, tending to move the collar out of its drive position, and thereby disengage the clutch components, are caused to act on the two locking means in opposite directions, so that such forces are assimilated by the cam shaft.

The foregoing preferred embodiments performs its locking functions independently of the mounting of the cam shaft in the mechanism, any forces tending to separate the clutch components being resisted by the cam shaft alone. Resistance to such forces need not be provided by the structure serving to mount the cam shaft, as in the prior structures. If the prior structures are struck and damaged, supporting parts may be spread apart, leading to play in the cam shaft mounting and/or movement of the cam shaft and resulting loss of locking function.

A hand brake mechanism in accordance with the invention includes, more particularly, a handwheel operatively connected to rotatable shaft means, a clutch collar interconnecting a drive member mounted on the shaft means for rotation therewith and a pinion mounted on the shaft means for rotation relative thereto and for being operatively connected in a power train to the car brakes. The collar is shiftable on the shaft between a drive position making the aforesaid interconnection, and a brake-release position wherein the connection is broken and the pinion is freely rotatable on the shaft. A pivotally mounted shift lever in the mechanism has collar-engaging members for shifting the collar between such positions. A cam shaft in the mechanism is provided with a cam which, when the cam shaft is rotated in one direction, engages the shift lever to shift the collar into the brake-release position. The cam shaft also is provided with a reaction member which engages the shift lever when the collar is in the drive position, to positively and mechanically lock the collar in the drive position. A second reaction member is provided on the cam shaft, in a preferred structure, such member engaging the collar when it is in the drive position, also to positively and mechanically lock the collar in the drive position. Any forces tending to move the collar out of its drive position act on the two reaction members in opposite directions, whereby the forces are assimilated by the cam shaft.

BRIEF DESCRIPTION OF THE DRAWINGS

The drawings illustrate a hand brake mechanism adapted for use on a railway car and incorporating improvements provided in accordance with the invention, without limitation thereto. In the drawings, like elements are identified by like reference symbols in each of the views, and.

DESCRIPTION OF THE PREFERRED EMBODIMENT

Figure 1:
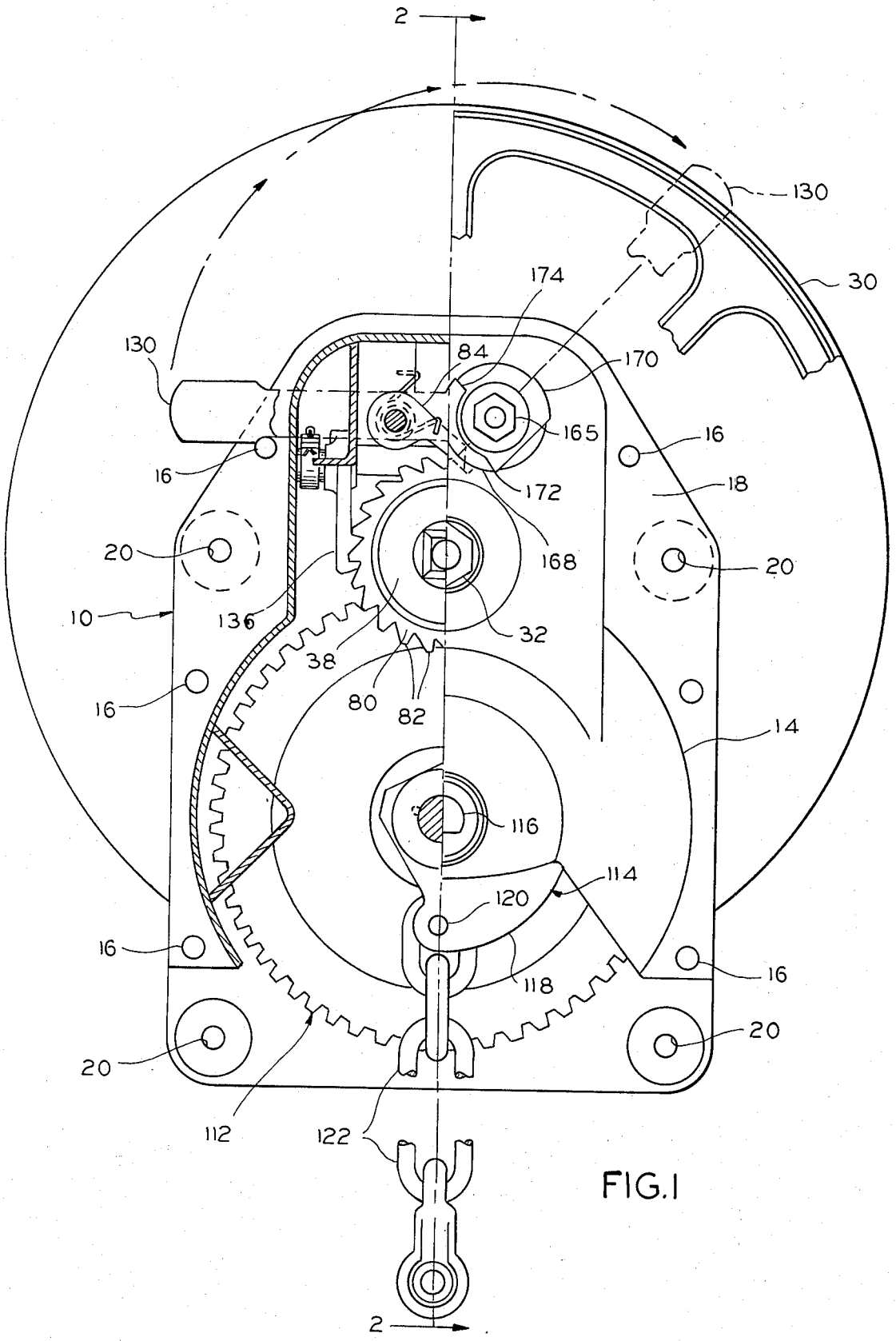
FIG. 1 is a partly front elevational and partly vertical sectional view, with parts broken away, of a hand brake mechanism constituting a preferred embodiment of the invention.

Inasmuch as the illustrative hand brake mechanism represents an improvement on my above-identified U.S. Pat. No. 3,988,944, and it includes various elements which are the same as or similar to the elements of the patent structure, such elements have been identified in the drawings by like reference numerals, for convenience of reference.

Figure 2:
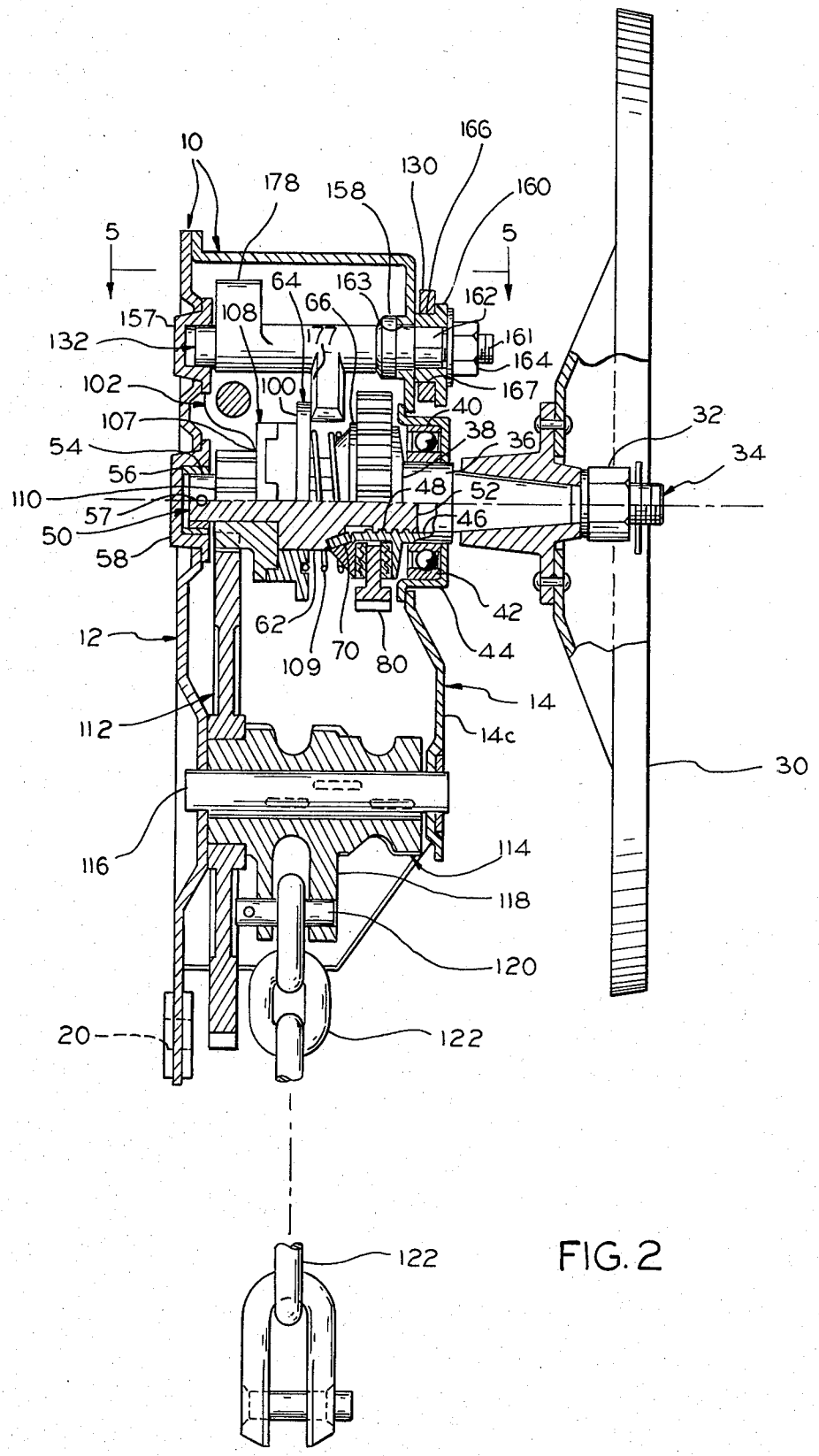
FIG. 2 is a vertical sectional view of the mechanism, with certain parts shown partly in elevation and partly in section, taken substantially on lines 2—2 of FIG. 1.
Figure 8:
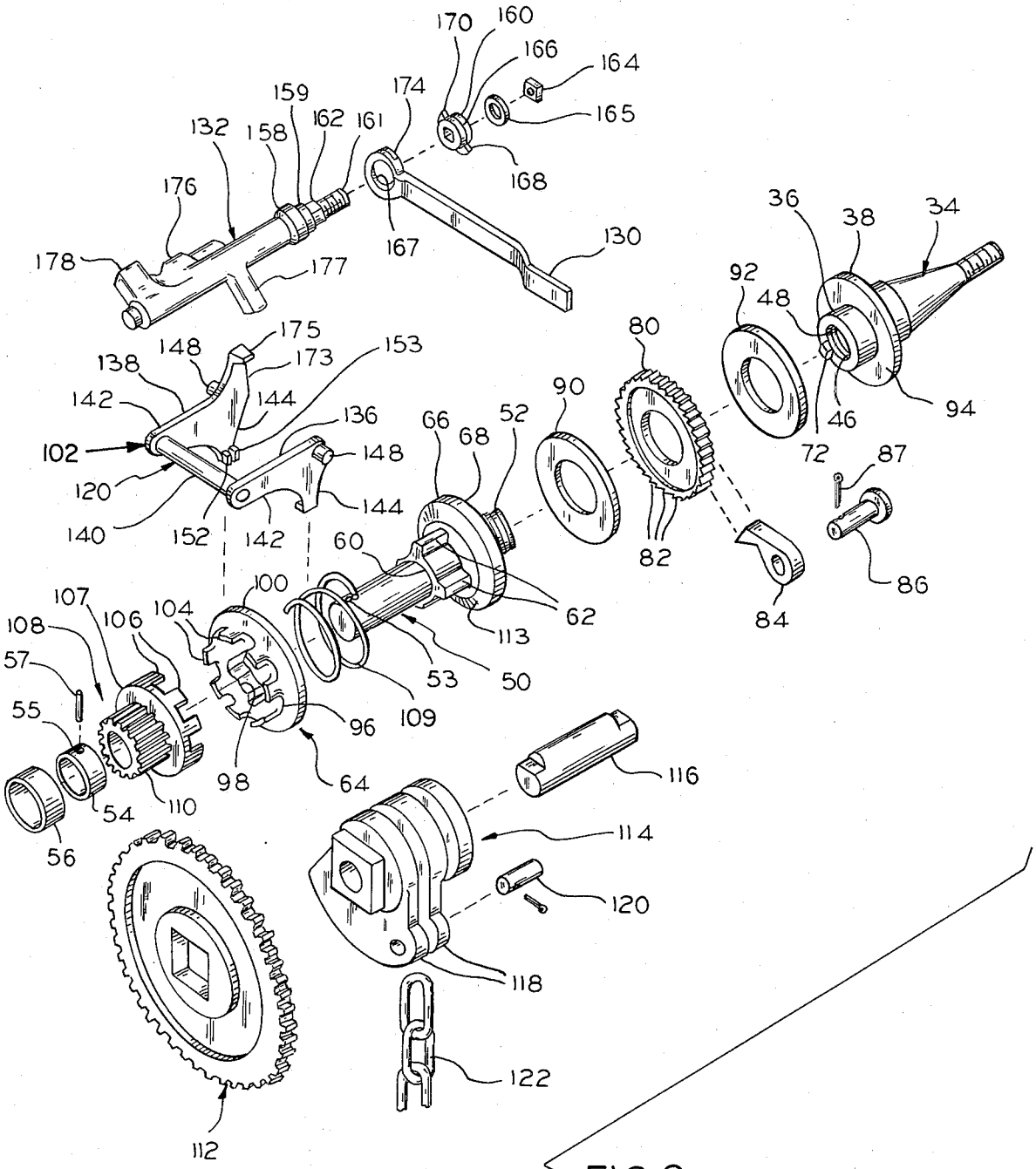
FIG. 8 is an exploded perspective view of the mechanism showing parts of a drive train and cooperating parts therein.

Referring to the drawings in detail and in particular to FIGS. 1, 2 and 8, a hand brake mechanism in accordance with the invention is mounted in a two-piece housing 10, which includes a rear base member 12, and a front cover member 14. These members are adapted to be secured together by rivets 16 or other fastening devices. The base member 12 of the housing 10 is in the form of a generally flat plate, while the cover member 14 is of cup shape configuration and embodies an outwardly extending flange 18 through which the rivets 16 extend. Bolt holes 20 are provided in the corner portions of the housing 10, in order that the entire assembly may be bolted to an end wall of a railway car in the usual manner.

A conventional handwheel 30 is affixed by means of a nut 32 to the front end of a horizontal rotatable handwheel or drive shaft 34. The shaft 34 extends through an opening in the cover member 14 and is provided on the rear portion thereof with an enlarged hub 36. A radial circular clutch reaction flange 38 extends from the hub 36 intermediate its ends. The hub 36 is journalled in an antifriction ball bearing assembly 40 which is nested within a recess 42 on the inside of a front wall plate 44 seated in an opening in the cover member 14. The rear end of the hub 36 is formed with a relatively deep central cylindrical socket 46 (see FIGS. 2 and 8) which has a threaded section 48 near its rim portion.

Referring to FIGS. 2–4 and 8, a horizontal axially shiftable clutch shaft 50 is disposed within the housing 10 in coaxial relationship to the handwheel shaft 34 and is provided at its front end with a reduced threaded pilot stem 52 which is threadedly received in the threaded section 48 of the socket 46. The rear end region of the clutch shaft 50 is cylindrical, and a retainer pin opening 53 extends therethrough. A cylindrical pinion retainer sleeve 54 having a retainer pin opening 55 therethrough is mounted on the end region of the shaft 50 and fixedly secured thereto by a retainer pin 57, which extends through the registering retainer pin openings 53 and 55. The retainer sleeve 54 is journalled in a cylindrical bushing 56, where the outer surface of the sleeve serves as a bearing surface for rotatably supporting the clutch shaft 50. The bushing 56 is fixedly mounted in a seat 58 in the upper portion of the base member 12. An enlarged integral medial drive member or slide section 60 is formed on the clutch shaft 50. The drive member 60 inclues four radial splines 62, which extend in the axial direction or longitudinally of the shaft 50. The splines 62 cooperate with a jaw-clutch collar 64, as described hereinafter.

Immediately forwardly of the drive member 60 and integrally therewith, a circular radial friction-clutch reaction flange 66 is integrally formed on the clutch shaft 50 and is provided with a forwardly facing clutch face 68. A stop pin 70 is threadedly received in an internally-threaded socket in the latter flange 66, cooperates with an abutment boss 72 (FIG. 8) on the rim of the hub socket 46, and limits the extent of relative turning movement of the two shafts 34 and 50.

The rear end of the hub 36 of the handwheel shaft 34 serves to support rotatably thereon a ratchet wheel 80 having teeth 82. A pivoted spring-pressed pawl 84 (see FIGS. 1, 5 and 8) is mounted on a horizontal cylindrical pin 86, such pin in turn being supported on the cover member 14 and secured by a cotter pin 87.

A friction disk 90 (see FIGS. 3, 4 and 8) is slidably mounted on the rear end of the hub 36 and interposed between the forwardly facing clutch face 68 of the reaction flange 66 and the rear face of the ratchet wheel 80. A similar friction disk 92 is slidably mounted on the rear end of the hub 36 and interposed between the rearwardly facing clutch face 94 of the reaction flange 38 and the front face of the ratchet wheel 80. The two friction disks 90,92 and the ratchet wheel 80 are capable of limited axial movement on the hub 36. Consequently, when the handwheel 30 is manually rotated in a clockwise direction as viewed in FIG. 1 and from the right-hand side of FIG. 2, the two friction disks 90,92 and the interposed ratchet wheel 80 will be compressed as a unit between the clutch faces 68 and 94. The entire friction clutch assembly including the handwheel shaft 34 and the clutch shaft 50 then becomes locked up and consequently rotates as a unit for application of the car brakes.

As best illustrated in FIGS. 2–4 and 8, the jaw-clutch collar 64 is capable of limited sliding movement on the drive member 60 on the clutch shaft 50. The clutch collar 64 includes a body 96 (FIG. 8), which defines a central opening 98 slidably receiving the drive member 60 and providing four keyways for the four splines 62 of the drive member. A radial flange 100 circumscribes the body 96 and provides engagement means by which the collar 64 may be shifted bodily in opposite directions along the axis of the clutch shaft 50, by a pivoted yoke assembly 102. The clutch collar 64 also is formed with an annular series of spaced apart clutch teeth 104, which project rearwardly from the body 96.

In the foregoing manner, the jaw-clutch collar 64 is mounted on the drive member 60 for releasable clutching engagement with a combined pinion and clutch wheel 108. The pinion and clutch wheel 108 includes a clutch wheel 107 having an annular series of forwardly projecting spaced apart clutch teeth 106, and a pinion 110 integral with the clutch wheel. The pinion and clutch wheel 108 is mounted for free rotation on the clutch shaft 50, between the pinion retainer sleeve 54 and the drive member 60, which serve to restrain the wheel 108 from rearward or forward longitudinal sliding movement on the shaft.

The clutch teeth 104 on the clutch collar 64 and the clutch teeth 106 on the clutch wheel 107 are constructed and spaced apart for interfitting with or interengaging each other, to place the clutch collar 64 and the clutch wheel 107 in clutching interengagement. Normally, the clutching interengagement is maintained by means of a helical compression spring 109 which surrounds the clutch shaft 50 and is interposed between the circular reaction flange 66 on such shaft and the body 96 of the clutch collar 64. The rear end of the spring 109 seats within an annular groove 111 (FIG. 3) which is formed in the front face of the clutch collar 64, while the front end of the spring bears against a frustoconical seating surface 113 on the rear face of the reaction flange 66. The spring 109 thus is centered about the clutch shaft 50 in coaxial relationship.

Referring to FIGS. 1, 2 and 8, the pinion 110 of the combined pinion and clutch wheel 108 meshes with a main winding spur gear 112 of relatively large diameter. The main winding gear 112 is mounted on and rotatable with a drum member 114 which, in turn, is mounted on a horizontal drum shaft 116 supported at its ends in the lower regions of the base member 12 and the cover member 14 of the housing. The drum member 114 is provided with an integral radially extending bifurcated crank arm 118 which carries at its distal end a horizontal crank pin 120. The latter passes through the uppermost link of a brake chain 122 and is secured in place by a cotter pin 123. The brake chain 122 is connected to the brake shoe mechanism (not shown), for application of the car brakes by tensioning the chain.

From the above description, it will be apparent that when the jaw-clutch collar 64 is maintained in its normally clutched engagement with the combined pinion and clutch wheel 108, the hand brake mechanism functions in the manner of a conventional non-spin brake mechanism, for application of the car brakes, or for release of braking tension in the chain 122, in small increments and without the application of spinning torque to the handwheel 30. When fully released, the brake chain 122 is unwound from the drum member 114 and, therefore, is slack. The friction clutch assembly, including the ratchet wheel 80 and the friction clutch disks 90 and 92, may be disengaged, and the clutch shaft 50 backed off, so to speak, on the internally-threaded section 48 of the socket 46. When it is desired to apply the car brakes, the handwheel 30 is rotated manually in a clockwise direction as viewed in FIG. 1 and from the righthand side of FIG. 2. As the handwheel 30 and the handwheel shaft 34 are turned in such clockwise direction, the clutch shaft 50, being in threaded engagement with the handwheel shaft, is caused to move forwardly, owing to the fact that the rotational movement of the pinion 110 is restricted by the inertia of the spur gear 112, the drum member 114 and the brake chain 122, as well as by the gravitational and tensional drag on the chain by members connecting the same to the car brakes. Ultimately, the reaction flange 66 on the clutch shaft 50 and the opposing reaction flange 38 on the handwheel shaft 34 function to lock up the entire friction clutch mechanism. The clutch shaft 50 then rotates in unison with the handwheel 30 and the handwheel shaft 34, and establishes a rigid power train leading to the brake chain 122. The drum member 114 rotates upon continued rotation of the handwheel 30, causing the crank pin 120 to move upwardly and the chain 122 to commence winding upon the drum member, thus gradually applying the car brakes.

At such time as the car brakes become set, the countertorque on the pinion 110 has a tendency to impart reverse rotation to the pinion. Such a tendency is effective to thread the forward end of the clutch shaft 50 into the socket 46 in the handwheel shaft 34 and maintain the friction clutch assembly locked up. Consequently, the pawl 84 will be effective against the entire clutch assembly and not merely against the ratchet wheel 80, and the brakes will not be released even though the handwheel 30 be released by the operator.

In order to effect gradual release of the car brakes, the handwheel 30 is turned in a counterclockwise direction, as viewed from the right-hand side of FIG. 2, through any desired small increment of rotation. The counterclockwise rotation of the handwheel 30 causes the mating threads on the shafts 34 and 50 to be turned relative to each other, backing off the clutch shaft 50 and thereby relieving the pressure of the friction disks 90 and 92, to disengage the friction clutch assembly. The clutch shaft 50 is permitted to rotate, and the pinion 110 rotates therewith, to partially release the tension in the brake chain 122. Such partial release will take place only during such time as counterclockwise turning force or torque is applied to the handwheel 30. Immediately upon cessation of such turning force, the countertorque which is applied through the power train leading from the brake chain 122 to the clutch shaft 50 will automatically re-engage the friction clutch parts, to prevent further relative rotation of the parts and release of chain tension.

Figure 3:
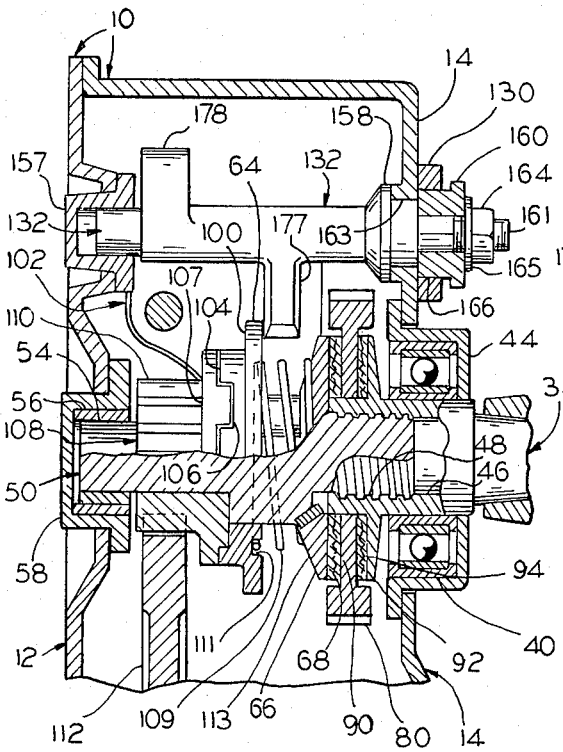
FIG. 3 is an enlarged fragmentary view similar to FIG. 2, illustrating a quick-release clutch of the mechanism with its components in driving engagement, and a cam shaft and a yoke assembly of the mechanism in corresponding dispositions.
Figure 4:
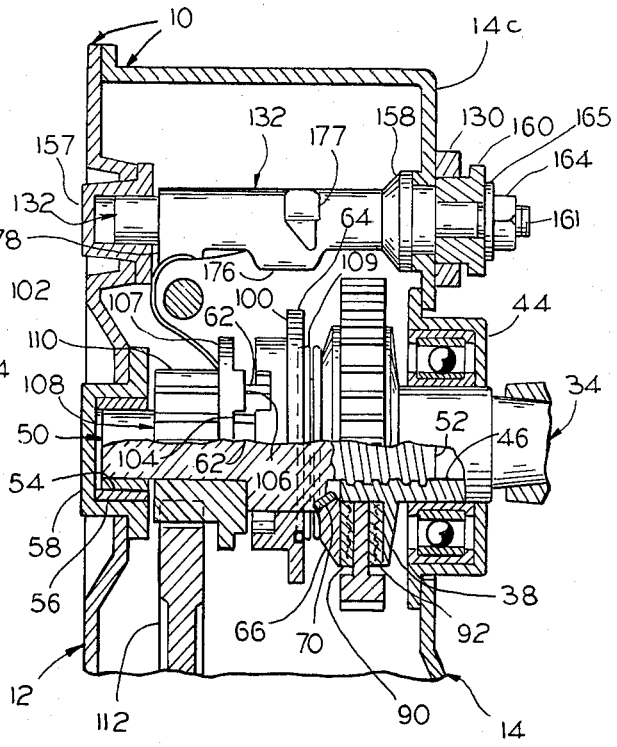
FIG. 4 is a view like FIG. 3, but with the clutch components, the cam shaft, and the yoke assembly illustrated in the dispositions assumed by them when the clutch components are disengaged to release the car brakes.

In order to effect quick release of the car brakes, the jaw-clutch collar 64 is shifted from its drive position, illustrated in FIG. 3, to its brake-release position, illustrated in FIG. 4. In the drive position, the collar 64 engages the splines 62, and the clutch teeth 104 on the collar intermesh with the clutch teeth 106 on the clutch wheel 107, to drivingly interconnect the drive member 60 and the pinion 110 for application of the car brakes. In the brake-release position, the clutch teeth 104 and 106 are separated, thereby breaking the connection between the drive member 60 and the pinion 110, so that the pinion is freely rotatable on the clutch shaft 50. Under the latter conditions, any tension in the brake chain 122 is released, thereby releasing the car brakes.

The control mechanism for shifting the clutch collar 64 between its position of clutched engagement with the clutch wheel 107 and its position of disengagement includes a quick-release handle or lever 130 which operates through a horizontal cam shaft 132 to control the rocking movements of the pivoted yoke assembly 102. The latter, in turn, operates as a dual shift lever or fork to engage the radial flange 100 of the clutch collar 64 and shift the same bodily into and out of clutching engagement with the combined pinion and clutch wheel 108.

Referring especially to FIGS. 5–8, the yoke assembly 102 is comprised of two shift levers or forks 136 and 138 which are rigidly connected together by a connecting bar 140. Each lever, in effect, is a bell crank lever having a generally horizontally extending rocker arm 142 and a depending collar-engagement arm 144. The levers are pivoted to the opposite side walls 14*a* and 14*b* of the cover member 14 of the housing 10, near the junctures between the arms 142 and 144. The pivotal mounting is provided by cradle supports 146 on the side walls 14*a*, 14*b*, and trunnions 148 on the levers 136,138. Each support 146 includes a bearing 147, a key 149 which interfits with the bearing 147, and a cotter pin 150 which extends through registering holes in the bearing and key, to secure them together. Each trunnion 48 is journalled in the bearing 147 of one of the supports 146. The connecting bar 140 extends between and has its ends fixed to the outer ends of the rocker arms 142.

The lower end of each collar-engagement arm 144 carries two collar-engaging members in the form of spaced, opposed lugs 152 and 153. The lugs project inwardly and straddle the peripheral flange 100 of the jaw-clutch collar 64, for imparting longitudinal shifting motion to the clutch collar 64 when the pivoted yoke assembly 102 is swung about the axis of its trunnions 148. An integral upstanding lug arm 173 forms a part of one lever 138 at the junction of its remaining arms 142 and 144. A locking lug 175 is integral with the outer end of the lug arm 173 and projects laterally inwardly therefrom. The locking lug 175 and the collar-engaging lugs 152,153 are disposed on opposite sides of the transverse axis through the trunnions 148, about which the yoke assembly 102 and the levers 136,138 thereof pivot. Consequently, the respective lugs 152,153 and 175 move in opposite directions between the rear base member 12 and the front cover member when the yoke assembly 102 is rocked about such axis.

The cam shaft 132 is disposed in the upper portion of the housing 10, above the level of the trunnions 148 and in parallel relation to the handwheel and clutch shafts 34 and 50. The ends of the cam shaft 132 are journalled for rotation on the base and cover members 2 and 14 of the housing, as illustrated in FIGS. 2–5 and 7. The rear end of the cam shaft 132 is mounted in the seat 157 in the base section 12, while the front end of the cam shaft 132 projects through the front wall 14*c* of the cover member 14.

Figure 9:
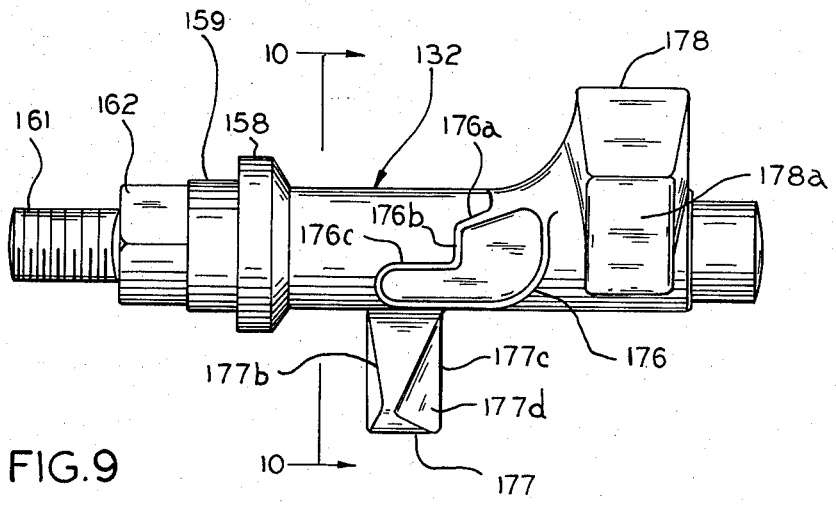
FIG. 9 is a side elevational view of the cam shaft.
Figure 10:
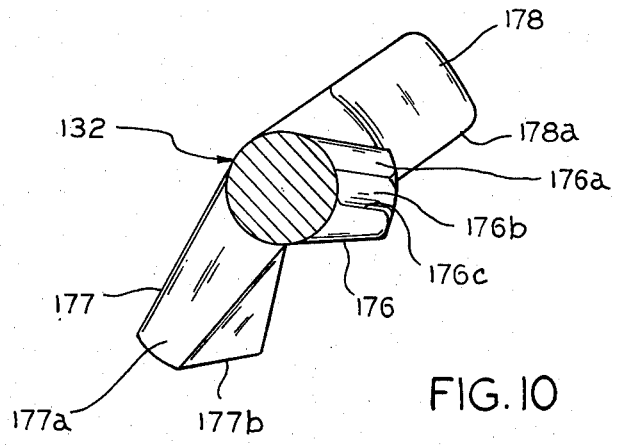
FIG. 10 is a cross sectional view of the cam shaft, taken substantially on line 10—10 of FIG. 9.

Referring also to FIGS. 8–10, the cam shaft 132 has an integral radial flange 158, a cylindrical journal 159, a squared portion 162, and a threaded portion 161 adjacent to its front end. The cam shaft is mounted in the front wall 14*c* with its flange 158 engaging the inside of the wall, and its journal 159 rotating in a circular bearing portion 163 in the wall. An abutment sleeve 160 is mounted on the squared portion 162 and adjacent to the outside of the front wall 14*c*. The sleeve 160 is secured by a nut 164 and washer 165 on the threaded portion 161.

Referring to FIGS. 1, 2, 7 and 8, in particular, a circular opening 167 is provided in the proximal end of the handle 130, which opening receives a cylindrical portion 166 of the abutment sleeve 160, to mount the handle thereon. A pair of angularly spaced stop lugs 168 and 170 on the abutment sleeve 160 and a pair of spaced abutment shoulders 172 and 174 on the inner end of the handle cooperate to provide a lost-motion connection between the sleeve and the handle, enabling the handle to swing in idle fashion and without function between two extreme positions as determined by the engagement of respective lugs and shoulders. During the idle motion of the handle 130, rocking movement of the cam shaft 132 is not effected. However, when the lower abutment shoulder 172 on the handle 130 engages the stop lug 168 on the abutment sleeve 160, counterclockwise (as seen in FIG. 1) or downward movement of the handle will impart counterclockwise rocking motion to the cam shaft 132. When the upper shoulder 174 on the handle 130 engages the stop lug 170 on the sleeve 160, clockwise or upward movement of the handle will impart clockwise rocking motion to the cam shaft 132.

In an alternative embodiment, not illustrated, the abutment sleeve 160 is omitted, and a quick-release handle having a square opening in its proximal end is mounted directly on the squared portion 162 on the cam shaft. In such embodiment, rotation of the handle in either direction causes the cam shaft 132 to rotate therewith, and there is no provision in the connection for lost motion.

Referring to FIGS. 8–10, in particular, a first reaction or locking member 176, a second reaction or locking member 177, and a brake-release or hold-down cam 178 are mounted on the cam shaft 132 integrally therewith, in angularly offset relation to each other and disposed rearwardly of the flange 158. The first reaction member 176 is a lug-like member extending laterally outwardly from the cam shaft 132. The first reaction member 176 includes a cam surface 176*a*, which lies substantially in a plane oblique or inclined with respect to the longitudinal axis of the cam shaft 132. The first reaction member 176 also includes a stop surface 176*b*, which lies substantially in a plane extending transversely of the cam shaft axis and extending at an obtuse angle or obliquely to the cam surface 176*a*. The first reaction member further includes a seating surface 176*c*, which lies substantially in a plane parallel to the cam shaft axis and substantially perpendicular to the stop surface 176*b*. A substantially right-angled recess is formed in the reaction member, and it is bounded by the stop surface 176*b*, the seating surface 176*c*, and the cam shaft 132, on respective sides thereof.

The second reaction member 177 is an elongated finger-like member extending laterally outwardly from the cam shaft 132. It includes a downwardly divergent elongated upper portion 177*a* and a wedge-shaped lower portion 177*b*. The upper and lower portions join along a protruding stop edge 177*c*. Adjacent thereto on the wedge-shaped portion is a wedging or camming surface 177*d*. The brake-release cam 178 is an elongated block-like member extending laterally outwardly from the cam shaft 132, and its undersurface 178*a* constitutes a cam surface.

The brake-release cam 178 is arranged for direct engagement of its cam surface 178*a* with one shift lever 138 of the yoke assembly 102, and the yoke assembly in turn directly engages the jaw-clutch collar 64, by means of the members 152 and 153. The first reaction member 176 also is arranged for direct engagement with the one shift lever 138. The second reaction member 177, on the other hand, is arranged for direct engagement with the collar 64. When the brake-release cam 178 is in its said engagement, the first and second reaction members 176 and 177 are disengaged, and vice versa.

The brake-release cam 178 cooperates with the distal end of the rocker arm 142 of one yoke assembly shift lever 138, i.e., the lever which bears the locking lug 175. Thus, and referring to FIGS. 1, 4 and 7, the quick-release handle 130 is pulled upwardly to the position illustrated in broken lines in FIG. 1, thereby to rotate the cam shaft 132 in the clockwise direction. The brake-release cam 178 engages the rocker arm 142 of the one lever 138 during such rotation. As a result, both of the rocker arms 142 move downwardly, whereby the shift levers 136 and 138 move pivotally about the axis of the trunnions 148. The engagement arms 144 of the levers 136 and 138 thereby are caused to rock forwardly. At this time, the rear collar-engaging members 152 on the engagement arms engage the flange 100 of the jaw-clutch collar 64, to shift the collar forwardly, while compressing the clutch spring 109. This action, which is like that of the above-described prior quick-release mechanisms, shifts the collar 64 from its drive position to its brake-release position, thereby to release the car brakes. During the engagement of the brake-release cam 178 with the cam-actuated lever 138, the reaction members 176 and 177 are in out-of-the-way positions, wherein they do not interfere with the movements of the yoke assembly 102 and the collar 64.

Figure 6:
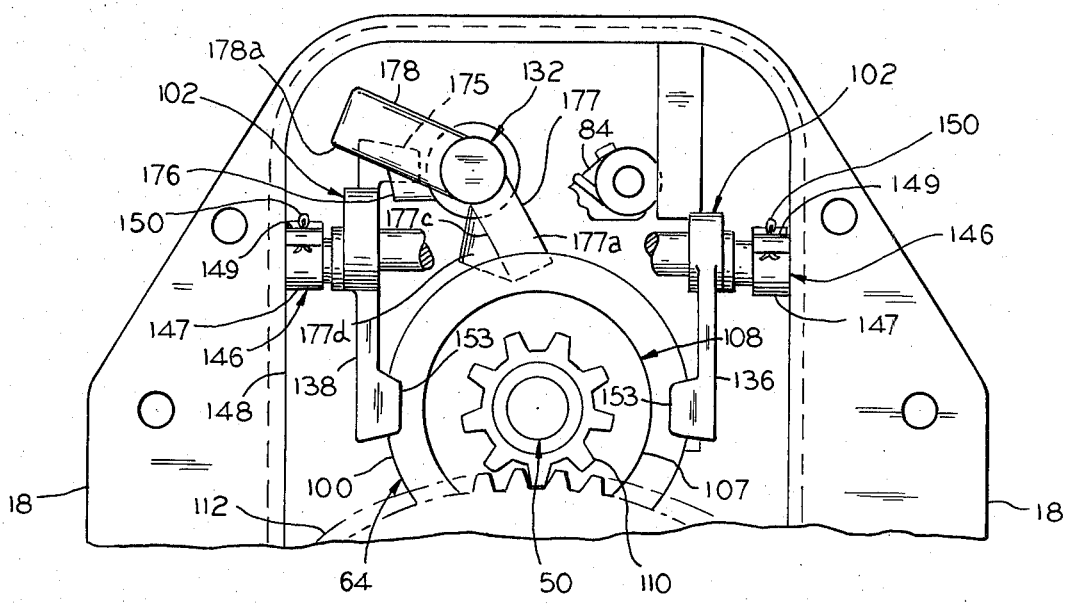
FIG. 6 is a similarly enlarged fragmentary rear elevational view of the mechanism with a base member thereof removed, certain parts broken away, and other parts omitted.
Figure 7:
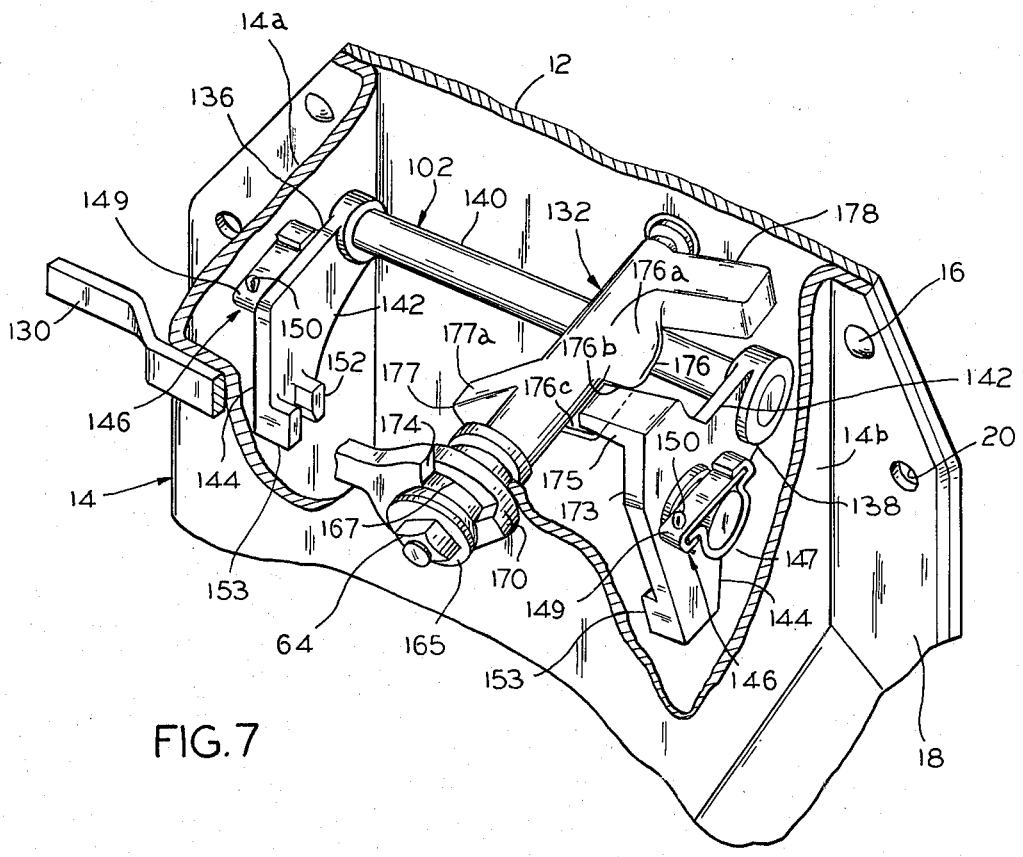
FIG. 7 is a fragmentary perspective view of the mechanism with certain parts broken away and other parts removed, illustrating the cam shaft and the yoke assembly in the positions which they assume when the components of the quick-release clutch, shown in other views therewith, are engaged and the brakes are applied.

The brake-release cam 178 is rendered ineffectual by rotation of the handle 130 in the counterclockwise direction, to the horizontal position of the handle as viewed in FIG. 1, the cam 178 then disengaging from the rocker arm 142 of the cam-actuated lever 138 and reaching a position spaced above the arm, as illustrated in FIGS. 6 and 7. At this time, the previously compressed jaw-clutch spring 109 is released, to restore the collar 64 to its position illustrated in FIG. 3, in driving engagement with the clutch wheel 107. As the handle 130 is rotated in the counterclockwise direction, the oblique cam surface **176*a* on the first reaction member 176 engages the locking lug 175 on the cam-actuated shift lever 138, and cams the lug so as to rotate the yoke assembly 102 about the axis of the trunnions 148. The rotation is such as to cause the engagement arms 142 and the collar-engaging members 152,153 thereon to shift rearwardly, with the front members 153 engaging the collar flange 100, thereby shifting the clutch collar 64 rearwardly, in cooperation with the clutch spring 109. This camming action is like that effected by the cam 176** in my above-identified U.S. Pat. No. 3,988,944.

Figure 5:
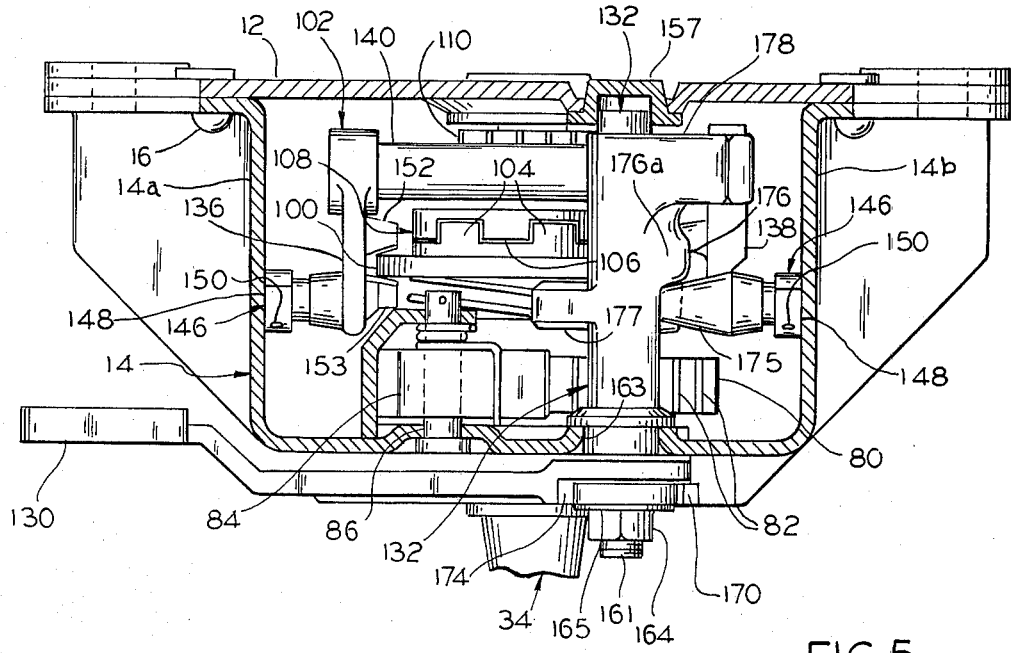
FIG. 5 is a further enlarged horizontal sectional view of the mechanism, taken substantially on line 5—5 of FIG. 2.

When the counterclockwise rotation of the handle 130 is complete, and the collar 64 is in its drive position, the locking lug 175 is received in the recess in the first reaction member 176, being seated on the seating surface **176*c* in abutting relation to the stop surface 176*b*, as seen in FIGS. 5–7. At this time, the stop surface 176*b* is substantially normal to the direction of rocking movement of the locking lug 175. The stop surface 176*b* is in a position relative to the locking lug 176 for engaging the lug with the first reaction member 176 to withstand forces which tend to move the clutch collar 64 out of its drive position, whereby the collar 64 is positively and mechanically locked in the drive position. Thus, the first reaction member 176 prevents the locking lug 175 on the cam-actuated shift lever 138 from moving rearwardly and the front collar-engaging members 153, which are on the opposite side of the pivotal axis of the shift levers 136,138, from moving forwardly, thereby to restrain the collar 64 from moving forwardly out of the drive position. Any forces tending to move the collar forwardly are exerted rearwardly on the stop surface 176*b* of the first reaction member 176** and assimilated by such member. The foregoing positive mechanical locking structure constitutes one of the improvements provided by the present invention, as referred to hereinabove.

Rotation of the handle 130 in the counterclockwise direction also serves to rotate the second reaction member 177 from the out-of-the-way position illustrated in FIG. 4 to a clutch collar-engaging position, illustrated in FIGS. 2, 3, and 5–7. During the rotation into the collar-engaging position, the wedging or camming surface **177*d* of the second reaction member 177 engages the front face of the collar 64 and cams the collar rearwardly, if need be. As rotation continues, the stop edge 177*c* on the second reaction member 177 moves into a position in front of the front face of the clutch collar 64, as seen in FIG. 6. At that time, the second reaction member 177 is disposed relative to the clutch collar 64** also to withstand forces which tend to move the collar out of its drive position.

It will be noted that in the latter case, any such forces act on the second reaction member 177 in the direction of movement of the collar 64, and opposite to the direction in which such forces act on the first reaction member 176. Since both reaction members are integral with the cam shaft 132, they transmit the forces to the cam shaft, and in opposite directions. Consequently, such forces are assimilated by the cam shaft and dissipated internally thereof. The locking effectiveness does not depend upon the integrity of the cam shaft mounting in the housing 10, but the cam shaft 132 and the reaction members 176 and 177 constitutes a self-contained and independent locking structure. Such structure constitutes an additional improvement provided by the invention.

The above-identified U.S. Pat. No. 3,040,597 discloses trip cam means 90 (FIG. 10), which includes a cam arm 88 similar to the brake-release cam 178 hereof, and a safety arm 91, similar to the second reaction member 177 hereof. The patent, however, provides no reaction member or the like comparable to the first reaction member 176 provided by the present invention. The patent provides no self-contained locking structure provided by its trip cam means, for withstanding clutch-disengagement forces independently of the mounting of the trip cam means or substantially so.

In operation of the hand brake mechanism, the quick-release handle 130 normally is maintained in the horizontal position illustrated in FIG. 1, where its gravitational weight serves to hold the cam shaft 132 in the jaw clutch-locking positions of the reaction members 176 and 177, illustrated in FIGS. 2, 3, and 5–7. The handwheel 30 may be operated either to tighten or to gradually release the car brakes, in the normal manner for a non-spin gradual release type of hand brake mechanism, as described above. Quick release of the tension in the brake chain 122, and corresponding release of the car brakes, is effected by moving the handle 130 in the clockwise direction from its horizontal position to its upwardly extending position, as illustrated in FIG. 1. The cam shaft 132 is rotated by the rotation of the handle 130, to disengage the jaw-clutch collar 64 from the clutch wheel 107, as illustrated in FIG. 4, and thereby permit the combined pinion and clutch wheel 108 to spin freely on the clutch shaft 50, so as to release the tension in the brake chain 122. The handwheel 30 remains stationary, since the power train leading to the chain 122 is broken with the disengagement of the jaw clutch. The jaw clutch is reengaged and the collar 64 thereof is locked in its drive position once more by counterclockwise movement of the handle 13, from its upwardly extending position to its horizontal position, at which time the mechanism again may be operated for tightening or for gradually releasing the brakes by rotating the handwheel 30.

While a preferred embodiment of the hand brake mechanism has been described and illustrated, it will be apparent to those skilled in the art that various changes and modifications may be made therein within the spirit and scope of the invention. It is intended that all such changes and modifications be included within the scope of the appended claims.

I claim:

1. In a hand brake mechanism adapted for use on a railway car and including a handwheel operatively connected to rotatable shaft means, a pinion mounted on said shaft means for rotation relative thereto and for being operatively connected in a power train to the car brakes, a drive member connected to said shaft means for rotation therewith, a clutch collar mounted on said shaft means and having drive member-engagement means and pinion-engagement means, said collar being shiftable on said shaft means between a drive position wherein it drivingly interconnects said drive member and said pinion for application of the car brakes, and a brake-release position wherein the connection is broken and the pinion is freely rotatable on the shaft means, a shift lever mounted for pivotal movement and having collar-engaging members alternately engageable with opposite sides of said collar for shifting the collar between said positions, lug means on said shift lever and spaced apart from the pivotal axis of the lever, a cam shaft mounted for rotation in opposite directions about its axis, and a release cam on said shaft arranged to alternately forcibly engage with and disengage from said shift lever upon rotation of the cam shaft in opposite directions about its axis for shifting said collar to said brake-release position upon said engagement and for enabling the collar to be shifted to said drive position upon said disengagement, the improvement which comprises:

a reaction member on said cam shaft and having a cam surface and a stop surface extending obliquely from the cam surface, said cam surface forcibly engaging said lug means upon rotation of the cam shaft in a direction to disengage said release cam from said shift lever, thereby to shift said collar to said drive position, and said stop surface being adapted to abut on said lug means when said collar is disposed in said drive position upon completion of the latter rotation of the cam shaft, thereby to positively and mechanically lock the collar in its drive position.

2. A brake mechanism as defined in claim 1 and wherein said reaction member defines a substantially right-angled recess adapted to receive said lug means therein and bounded on one side by said stop surface, and said stop surface is substantially normal to the direction of movement of said lug means in the drive position of said collar.

3. A brake mechanism as defined in claim 1 and wherein said lug means is disposed on the opposite side of the pivotal axis of the lever from said collar-engaging members, and including a second reaction member on said cam shaft and interposed in the path of shifting movement of said collar when the collar is disposed in said drive position upon completion of said latter rotation of the cam shaft, thereby to positively and mechanically lock the collar in its drive position, whereby any forces tending to shift the collar out of its drive position when locked therein by said stop surface and by said second reaction member act on the stop surface and the reaction member in opposite directions, so that said forces are assimilated by the cam shaft.

4. A brake mechanism as defined in claim 3 and wherein said first-named reaction member defines a substantially right-angled recess adapted to receive said lug means therein and bounded on one side by said stop surface, and said stop surface is substantially normal to the direction of movement of said lug means in the drive position of said collar.

5. In a hand brake mechanism adapted for use on a railway car and including a handwheel operatively connected to rotatable shaft means, a pinion mounted on said shaft means for rotation relative thereto and for being operatively connected in a power train to the car brakes, a drive member connected to said shaft means for rotation therewith, a clutch collar mounted on said shaft means and having drive member-engagement means and pinion-engagement means, said collar being shiftable on said shaft means between a drive position wherein it drivingly interconnects said drive member and said pinion for application of the car brakes, and a brake-release position wherein the connection is broken and the pinion is freely rotatable on the shaft means, a shift lever mounted for pivotal movement about a medial axis and having collar-engaging members disposed to one side of the axis and alternately engageable with opposite sides of said collar for shifting the collar between said positions, a cam shaft mounted for rotation in opposite directions about its axis, and a release cam on said cam shaft arranged to alternately forcibly engage with and disengage from said shift lever upon rotation of the cam shaft in opposite directions about its axis for shifting said collar to said brake-release position upon said engagement and for enabling the collar to be shifted to said drive position upon said disengagement, the improvement which comprises:

a first reaction member on said cam shaft, engagement means on said shift lever on the opposite side of its axis for said collar-engaging members, said first reaction member being adapted to engage said engagement means when said collar is disposed in said drive position, thereby to positively and mechanically lock the collar in its drive position, and a second reaction member on said cam shaft and adapted to engage said collar when the collar is disposed in said drive position, thereby to positively and mechanically lock the collar in its drive position, whereby any forces tending to shift the collar out of its drive position when locked therein by said reaction members act on the reaction members in opposite directions, so that said forces are assimilated by the cam shaft.

6. A brake mechanism as defined in claim 5 and wherein said engagement means comprises a lug on said shift lever and spaced apart from its axis, and including a stop surface on said first reaction member substantially normal to the direction of movement of said lug in the drive position of said collar and adpated to abut on the lug to effect said engagement of the first reaction member with said engagement means.

7. A brake mechanism as defined in claim 6 and wherein said first reaction member defines a substantially right-angled recess adapted to receive said lug therein and bounded on one side by said stop surface.

8. A brake mechanism as defined in claim 6 and wherein said second reaction member is interposed in the path of shifting movement of said collar when the collar is disposed in said drive position.

* * * * *